US007522028B2

(12) United States Patent
Sano

(10) Patent No.: US 7,522,028 B2
(45) Date of Patent: Apr. 21, 2009

(54) MAGNETIC ELEMENT

(75) Inventor: Kan Sano, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 11/382,505

(22) Filed: May 10, 2006

(65) Prior Publication Data

US 2006/0268457 A1 Nov. 30, 2006

(30) Foreign Application Priority Data

May 25, 2005 (JP) ..... P2005-152671

(51) Int. Cl.
*H01F 27/24* (2006.01)

(52) U.S. Cl. ..... 336/212; 315/368.28

(58) Field of Classification Search ..... 336/212
See application file for complete search history.

(56) References Cited

U.S. PATENT DOCUMENTS 2,413,201 A 12/1946 Tillman
3,287,678 A * 11/1966 Okamoto et al. ..... 336/83
3,783,417 A * 1/1974 Osada et al. ..... 333/185
4,800,356 A * 1/1989 Ellis ..... 336/184
5,266,916 A * 11/1993 Kijima ..... 336/160
5,812,045 A * 9/1998 Ishikawa et al. ..... 336/83
2004/0113741 A1 6/2004 Li et al.

FOREIGN PATENT DOCUMENTS

EP 1049113 A2 2/2000
JP 60-174214 11/1985
JP 60-174215 11/1985
JP 2000182838 6/2000

OTHER PUBLICATIONS

A European Search report from the European Patent Office dated Aug. 3, 2007 for European Patent Application No. 0625254439-1231.
A Japanese Office Action from the Japanese Patent Office dated Aug. 21, 2008, for Japanese Patent Application No. 2005-152671.

* cited by examiner

*Primary Examiner*—Lincoln Donovan
*Assistant Examiner*—Joselito Baisa
(74) *Attorney, Agent, or Firm*—Sonnenschein Nath & Rosenthal LLP

(57) ABSTRACT

A magnetic element including a first core and a second core each of which has a winding core provided with a flange portion having a flange surface at least at one end thereof; and an intermediate core disposed between said first core and said second core and being integrally connected with said first core and said second core so as to form a closed magnetic circuit.

4 Claims, 11 Drawing Sheets

S1≦S3, and Also S1≦5XS1

MAGNETIC ELEMENT

CROSS REFERENCE TO RELATED APPLICATIONS

The present application claims priority to Japanese Application No. P2005-152671 filed on May 25, 2005, which application is incorporated herein by reference to the extent permitted by law.

BACKGROUND OF THE INVENTION

The present invention relates to a magnetic element and more particularly relates to an inductance element that is used for a power source.

In recent years, there has been a strong requirement to reduce the size of magnetic elements has been strongly required in view of substrate configurations with high density mounting and multilayer arrays, and at the same time there has been a strong requirement to lower the cost of product. As a form of a magnetic element in the past, there has been known one that adopts a configuration combining a flanged core and ring-type core made of ferrite magnetic cores (for example, refer to Patent Reference 1).

Furthermore, there has been known a circuit configuration in which a plurality of magnetic elements (inductance elements, for example) having the same or similar electric characteristic or shape are disposed on a mounting substrate as shown in FIG. 1. See, [Patent Reference 1] Published Japanese Patent Application No. 2002-313635.

However, when the plurality of inductance elements having the same or similar electric characteristic or shape are disposed on the mounting substrate as shown in FIG. 1, it is necessary to secure a mounting space proportional to a layout area of those inductance elements on the mounting substrate and there arises such a problem that the mounting substrate becomes large.

Moreover, since a mounting element to be mounted on a mounting substrate, which is not limited to an inductance element, needs to keep an appropriate interval to an adjacent mounting element in order to prevent damages of the element during mounting work, there arises such a problem that a layout area of inductance elements to be mounted needs to be further reduced in order to satisfy a recent requirement for high density mounting at a high level.

SUMMARY OF THE INVENTION

The present invention provides a magnetic element with a reduced layout area on a mounting substrate.

A magnetic element according to an embodiment of the present invention is configured to have a first core and a second core each of which has a winding core provided with a flange portion having a flange surface at least at one end thereof; and an intermediate core disposed between said first core and said second core and integrally connected with said first core and said second core so as to form a closed magnetic circuit.

In addition, the magnetic element is configured such that the relations $S1 \leqq S3$ and also $S1 \leqq S2$ are satisfied, where a cross-sectional area of the winding core of the above-described first core in a direction parallel to the above-described flange surface is S1, a cross-sectional area of the above-described intermediate core in a direction parallel to the above-described flange surface is S2 and a cross-sectional area of the winding core of the above-described second core in a direction parallel to the above-described flange surface is S3.

In some embodiments a longitudinal axis direction of the above-described winding cores may lie in a vertical direction or is perpendicular relative to a mounting surface provided in the above-described flange portion.

Alternatively, in some embodiments the longitudinal axis direction of the above-described winding cores may lie in a horizontal direction or is parallel relative to the mounting surface provided in the above-described flange portion.

A magnetic element according to the embodiment of the present invention reduces the layout area of the magnetic element by using a common core to flow magnetic fluxes generated from the plurality of magnetic elements.

According to principles of the present invention, the layout area of the magnetic element can be reduced, while at the same time it is possible to connect securely the first core, the second core and the intermediate core, and furthermore, the magnetic element can be easily manufactured. In addition, according to principles of the present invention, it is possible to mount the plurality of magnetic elements in high density since the layout area of the magnetic elements to the mounting substrate can be reduced.

DETAILED DESCRIPTION OF THE PRESENTLY PREFERRED EMBODIMENTS

Although examples of best modes for carrying out the present invention are explained hereinafter by referring to the accompanied drawings, it is apparent that the present invention is not limited to the following embodiments.

Figure 1:
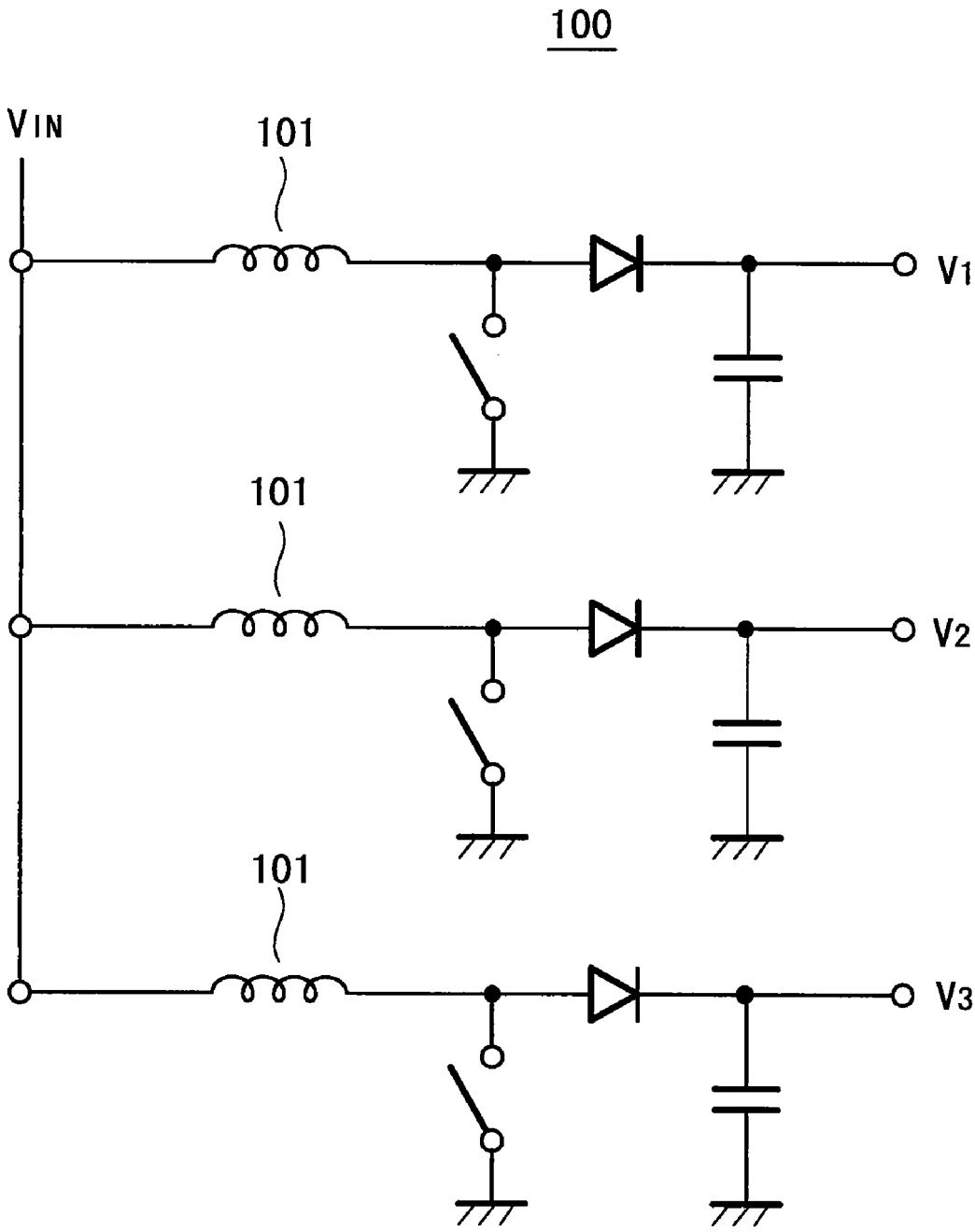
FIG. 1 (RELATED ART)
FIG. 1 is a diagram showing a past circuit configuration in which a plurality of magnetic elements in related art are disposed.
Figure 2:
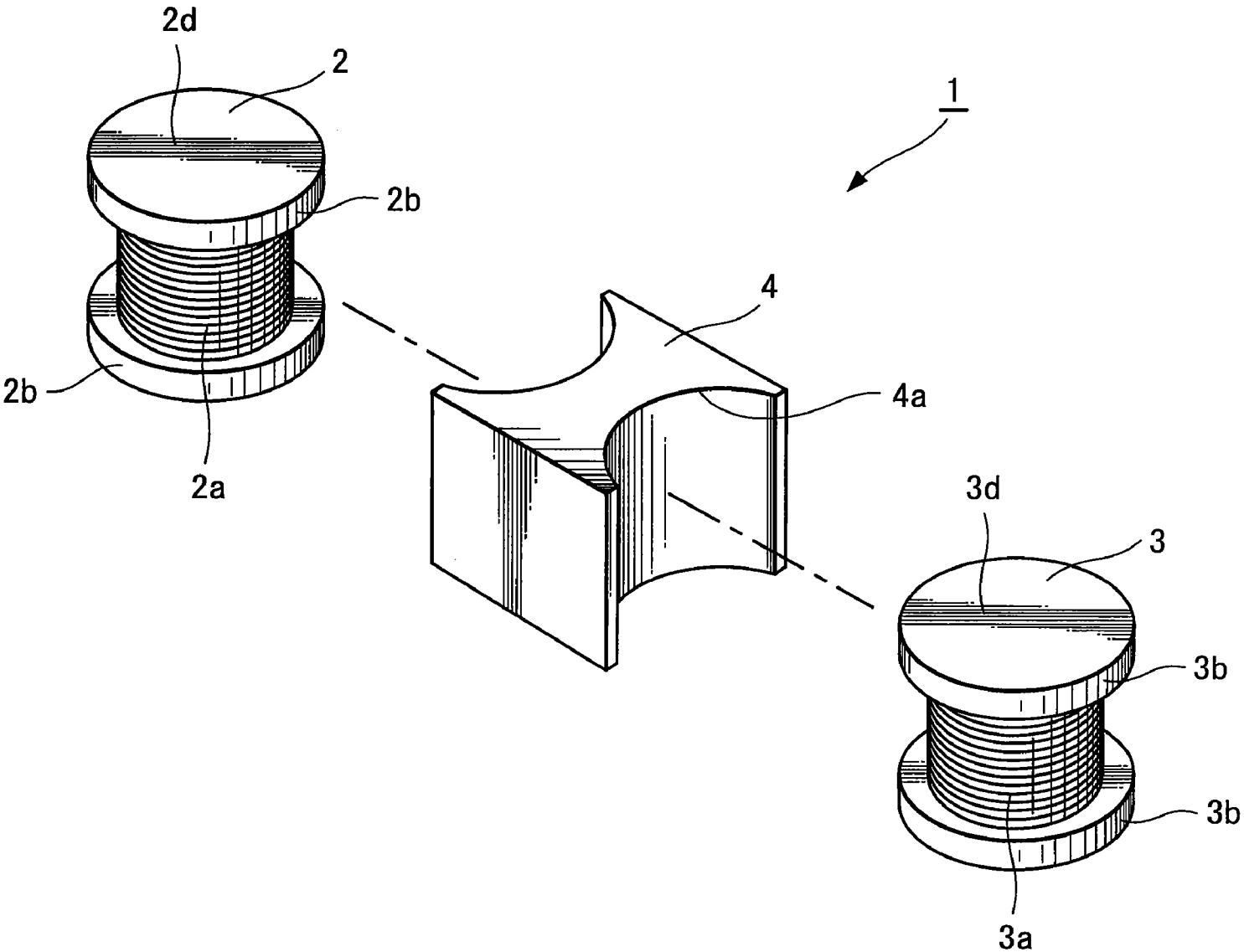
FIG. 2 is an exploded perspective view of a first magnetic element embodying principles of the present invention.

FIG. 2 is an exploded perspective view of a magnetic element according to a first embodiment of the present invention.

An inductance element 1 as a magnetic element is configured to have a first flanged core 2, a second flanged core 3 and an intermediate core 4 as shown in FIG. 2. In addition, the first flanged core 2 and the second flanged core 3 have the same shape in this embodiment. It should be noted that the first and second flanged cores 2 and 3 may have mutually different diameters of winding cores and shapes of the flanges.

The first flanged core 2 is configured to have flange portions 2*b* having planar-shaped flange surfaces 2*d* and a first coil 2*a* wound around a winding core (not illustrated) that is integrally connected with the flange portions 2*b*. Similarly, the second flanged core 3 is configured to have flange portions 3*b* having planar-shaped flange surfaces 3*d* and a second coil 3*a* wound around a winding core (not illustrated) that is integrally connected with the flange portions 3*b*. In addition, the first flanged core 2 and the second flanged core 3 are formed of a magnetic material using Ni—Zn type ferrite.

The intermediate core 4 is formed such that a height thereof corresponds to the first flanged core 2 and the second flanged core 3, and a fit-in portions 4*a* having such shapes that correspond to outer circumferential shapes of the flange portion 2*b* and the flange portion 3*b* are formed on the surfaces opposing to the first flanged core 2 and the second flanged core 3. The intermediate core 4 is formed of a material using Ni—Zn type ferrite, which is shaped by grinding one that is pressed into a rectangular form by metal mold press, for example.

Figure 3:
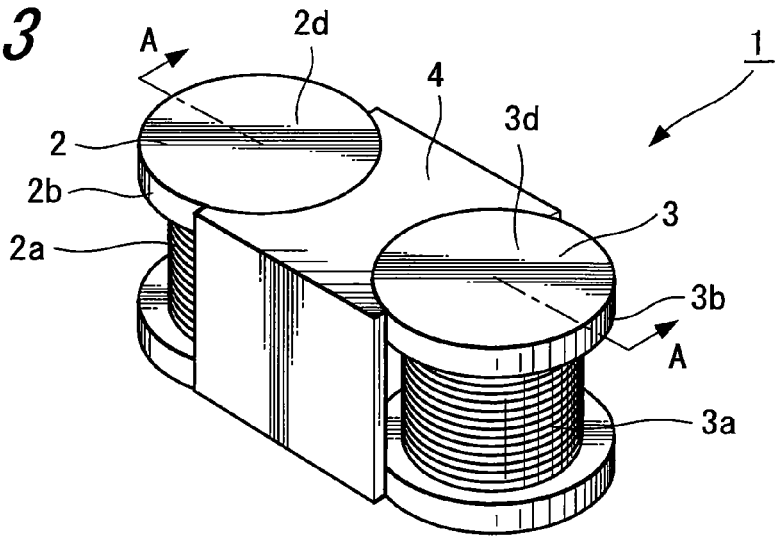
FIG. 3 is a perspective view of the magnetic element of FIG. 2.

FIG. 3 is a perspective view of the magnetic element of FIG. 2.

The inductance element 1 is assembled in such a manner that the outer circumferential shapes in the flange portion 2*b* of the first flanged core 2 and the flange portion 3*b* of the second flanged core 3 partially correspond to the fit-in portions 4*a* of the intermediate core 4. In other words, a closed magnetic circuit is formed in the inductance element 1 by the first flanged core 2, the second flanged core 3 and the intermediate core 4. In addition, the inductance element 1 is assembled such that the flange surface 2*d*, the flange surface 3*d* and surfaces of upper and lower directions of the intermediate core 4 form one planar surface. It should be noted that lateral surfaces of the flanged portions 2*b* and 3*b* are fixed to desired portions of the intermediate core 4 corresponding to those lateral surfaces by applying adhesives thereto when the flanged cores 2 and 3 are assembled into the intermediate core 4.

Here, it is necessary to provide a gap in the magnetic path in order to use this inductance element 1 as a power source, more specifically in order to comply with large electric current. As a method of providing the gap, it can be considered that the gap is formed against the intermediate core 4 by making an outer circumferential diameter of at least one flange portion of the flanged core smaller than an outer circumferential diameter of the other flange portion by a specific size. Also, as another method, effective magnetic permeability of the intermediate core 4 is set lower than effective magnetic permeability of the flanged cores 2 and 3, and thereby it is possible to cause an action practically as the gap. It should be noted that various alterations such as one using a magnetic material of low magnetic permeability and one using a mixture of resin and magnetic powder as a core material are possible when that method is used.

Figure 4:
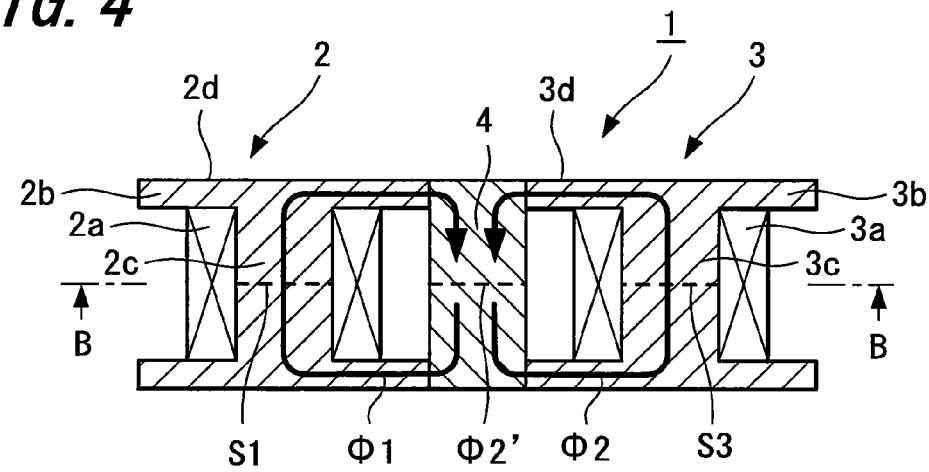
FIG. 4 is a cross-sectional view of the magnetic element of FIGS. 2 and 3 taken along the line A-A in FIG. 3.

FIG. 4 is a cross-sectional view of the magnetic element of FIGS. 2 and 3 taken along line A-A in FIG. 3.

The coil 2*a* is wound around a winding core 2*c* of the first flanged core 2 and the coil 3*a* is wound around a winding core 3*c* of the second flanged core 3. In addition, magnetic fluxes Φ1 and Φ2 running though the winding cores 2*c*, 3*c*, flange portions 2*b*, 3*b*, and the intermediate core 4 in directions of arrows shown in the figure are generated from those coil 2*a* and coil 3*a*.

Here, a cross-sectional area of the winding core 2*c* and a cross-sectional area of the winding core 3*c*, which are parallel to the flange surfaces 2*d* and 3*d*, are respectively defined as S1 and S3, and a cross-sectional area of the intermediate core 4, which is parallel to the flange surfaces 2*d* and 3*d* and is a narrowest portion (more precisely a cross-sectional area at one half of the height of the intermediate core) as shown in the figure, is defined as S2'.

Figure 5:
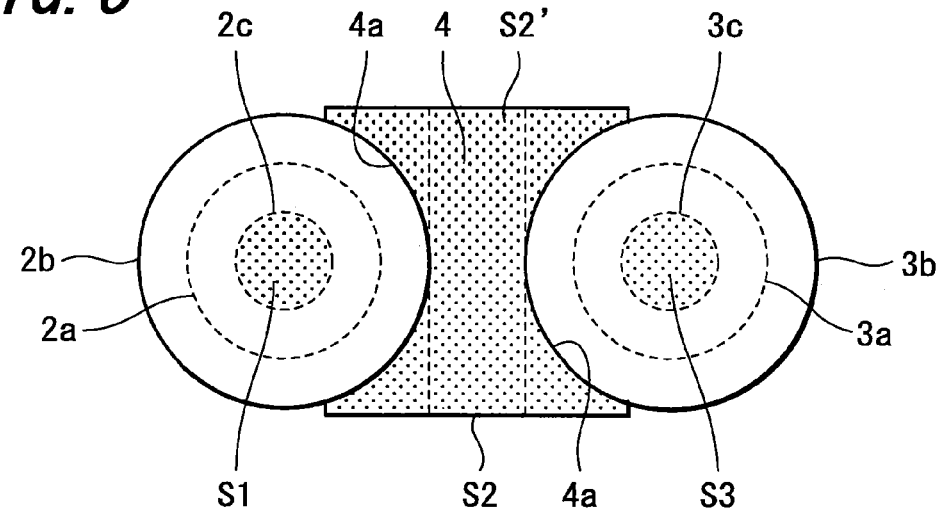
FIG. 5 is a cross-sectional plan view of the magnetic element of FIGS. 2-4 taken along the line B-B in FIG. 4.

FIG. 5 is a cross-sectional view of the magnetic element of FIGS. 2-4 taken along the line B-B in FIG. 4.

The coil 2*a* is wound around the winding core 2*c* of the cross-sectional area S1, and the flange portion 2*b* has an outer circumferential diameter larger than an outer circumferential diameter of the coil 2*a*. Similarly, the coil 3*a* is wound around the winding core 3*c* of the cross-sectional area S3, and the flange portion 3*b* has an outer circumferential diameter larger than an outer circumferential diameter of the coil 3*a*.

In addition, the outer circumferences of the flange portion 2*b* and flange portion 3*b* partially fit into the fit-in portions 4*a* provided in the intermediate core 4. Here, a cross-sectional area of the intermediate core 4, which is parallel to the flange surfaces 2*d* and 3*d* and is a widest portion (more precisely a cross-sectional area at positions of upper and lower end portions of the intermediate core 4), is defined as S2.

According to the inductance element 1 of this embodiment, since the intermediate core 4 has the fit-in portions 4*a* that correspond to the shapes of the flange portions 2*b* and 3*b*, a layout area of the inductance element 1 can be reduced and at the same time the flanged cores 2 and 3 can be bonded securely to the intermediate core 4. Although a magnetic saturation state occurs soon when contact areas between the flange portions 2*b*, 3*b* and the intermediate core 4 are small in a case such as point contacts, for example, a ratio between the magnetic saturation caused in the intermediate core 4 and the magnetic saturation caused in the flanged cores 2 and 3 can be brought even so that the magnetic saturation state can be delayed from occurring locally in the inductance element 1 by forming such that the shapes of the fit-in portions 4*a* of the intermediate core 4 correspond to the shapes of the flange portions 2*b* and 3*b* as the inductance element 1 of this embodiment.

Advantageously, the inductance element 1 of this embodiment can be manufactured quite easily since both the flanged cores 2, 3 and the intermediate core 4 have simple configurations. More specifically, since the cores for winding the coils 2*a* and 3*a* are the flanged cores 2 and 3 which are generally used, productivity and manufacturing technology related to processes from manufacturing of the core to winding of the coil become very stable ones. In addition, since the shape of the intermediate core 4 is also simple and easy to manufacture, manufacturing costs of the magnetic element can be lowered comprehensively.

In addition, it is advantageous that an overall balance in magnetic saturation of the flanged cores 2, 3 and the intermediate core 4 is excellent for various usages since the cross-sectional areas are set such that S1≦S3 and also S1≦S2, where the cross-sectional area of the winding core 2*c* of the flanged core 2 is S1, the cross-sectional area of the winding core 3*c* of the flanged core 3 is S3 and the cross-sectional area of the intermediate core 4 is S2.

More specifically, when S1≦S3 and S1=S2, no magnetic saturation occurs when electric current flows to either one coil of the coil 2*a* of the first flanged core 2 or the coil 3*a* of the second flanged core 3, and also it is possible to reduce the layout area of the inductance element 1.

Also, when S1≦S3 and 5×S1=S2, no magnetic saturation occurs in the intermediate core 4 when electric current flows to any coil of the coil 2*a* of the first flanged core 2 and the coil 3*a* of the second flanged core 3, and also it is possible to achieve high rigidity of the inductance element 1 since the cross-sectional area S2 of the intermediate core 4 becomes large.

In addition, when S1≦S3 and S1>S2, the magnetic saturation first occurs in the intermediate core 4 when excess current flows at least to the coil 2*a* and there is a possibility to cause a rapid decrease in an electric characteristic (typically inductance value) of the inductance element 1 since the cross-sectional area S2 of the intermediate core 4 becomes practically smaller than the cross-sectional area S1 of the winding core 2*c* of the flanged core 2. Furthermore, a decrease in mechanical strength and rigidity of the inductance element 1 becomes remarkable since the cross-sectional area S2 of the intermediate core 4 becomes small.

Further, when S1≦S3 and 5×S1<S2, it is possible to obtain the reliability of the inductance element against the magnetic saturation that is caused at the time of flowing the electric current, but the size of the inductance element 1 becomes large since the cross-sectional area S2 of the intermediate core 4 becomes large. Moreover, since there arises a necessity of making the cross-sectional area S2' in the narrowest size portion of the intermediate core 4 equivalent to or larger than the cross-sectional area S1 of the winding cores 2*c* and 3*c* of the flanged cores in order to maintain sufficient strength of the inductance element 1, the size of the inductance element 1 becomes large after all. In addition, a value of the cross-sectional area S2 of the intermediate core turns out to be approximately 5×S1 to the cross-sectional area S1 of the winding core in order to design the intermediate core 4 that has an external shape conforming with the shapes of the flange portions 2*b* and 3*b* of the flanged cores.

Based on the considerations described above, the inductance element 1 of this embodiment is configured such that the relations S1≦S3 and also S1≦S2 are satisfied, and more preferably configured such that the relations S1≦S3 and S1≦S2≦5×S1 are satisfied, where the cross-sectional area of the winding core 2*c* of the first flanged core 2 is S1, the cross-sectional area of the intermediate core is S2 and the cross-sectional area of the winding core 3*c* of the second flanged core is S3.

Figure 7:
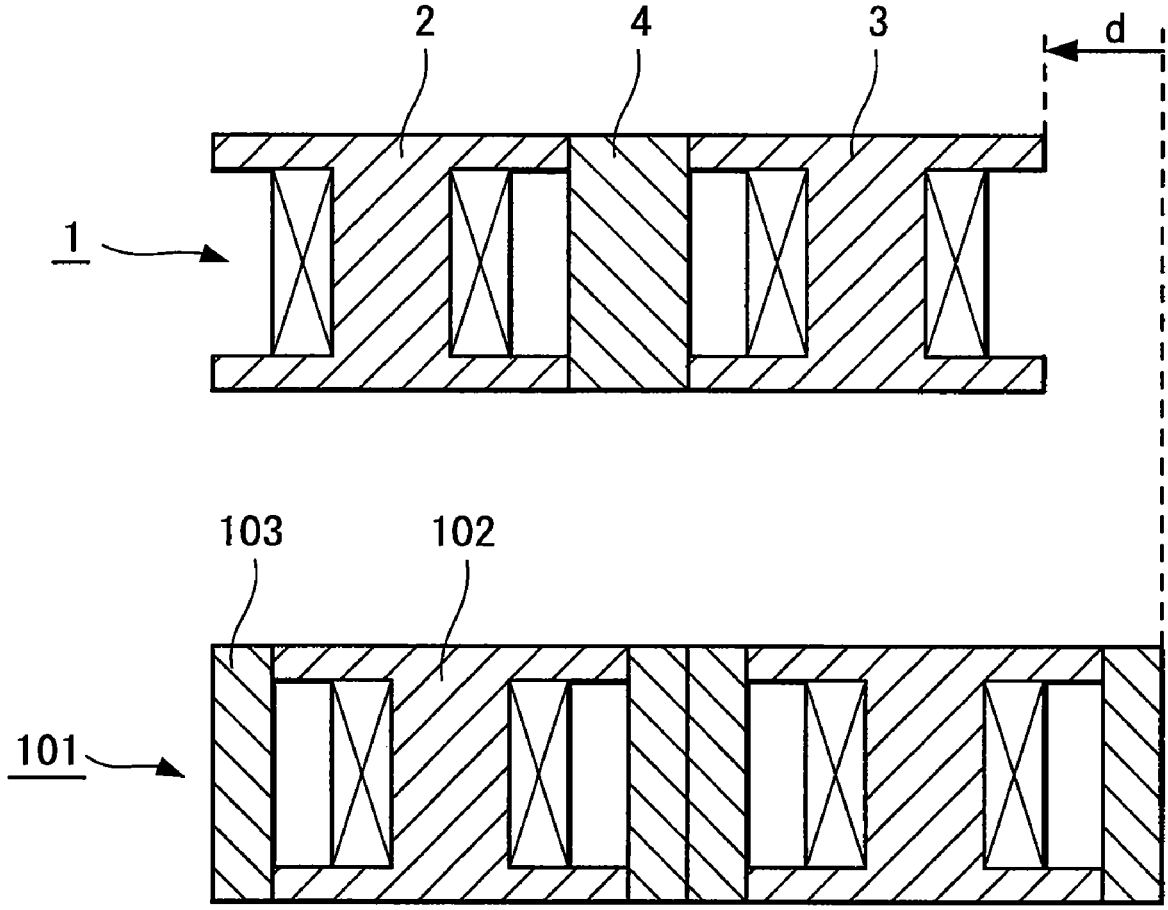
FIG. 7 is a cross-sectional comparison of a magnetic element of the related art and a magnetic element embodying principles of the present invention.

In addition, with the inductance element 1 of this embodiment, it is possible to reduce the layout area of the inductance element 1 by a length d as shown in FIG. 7 when the inductance element 1 of this embodiment is compared with a state that two pieces of inductance element 101 in related art consisting of a flanged core 102 and a ring-type core 103 are closely connected. Furthermore, it is possible to obtain the inductance element 1 which is low costs and at the same time has equal or better electric characteristics since two pieces of ring-type core 103 can be replaced with one intermediate core 4. More specifically, according to the inductance element 1 of this embodiment, it becomes possible to reduce one's own mounting space of the inductance element by merging two pieces of inductance element 101 used in the past into one and in addition, the inductance element 1 of this embodiment is the one that has two coils 2*a* and 3*a* in one body without causing magnetic coupling.

Moreover, according to the inductance element 1 of this embodiment, it becomes possible that two magnetic elements used originally on a circuit substrate are merged into one by using two flanged cores 2 and 3 that have been generally adopted from the past and disposing the intermediate core 4 of a simple shape in the middle of the above-described flanged cores 2 and 3, and it becomes possible to obtain practically an effect of the reduction in layout area of the inductance element 1 and the reduction in costs since there is no such case that a size of the inductance element 1 of this embodiment becomes twice as big as the one in related art at this time.

Figure 6:
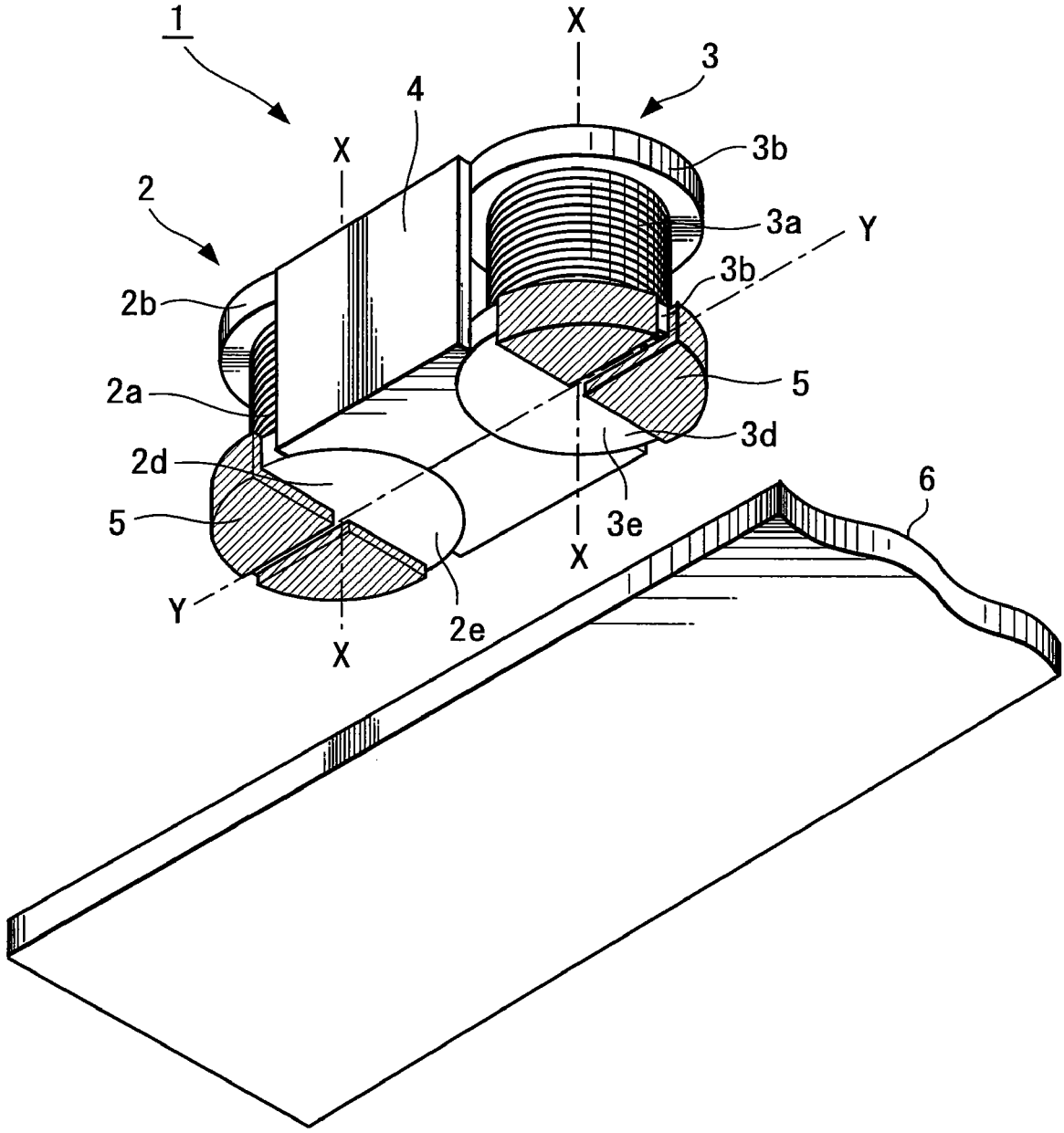
FIG. 6 is a perspective view illustrating installation of the magnetic element of FIGS. 2-5 on a mounting substrate.

FIG. 6 is a perspective view illustrating installation of the magnetic element of FIGS. 2-5 on a mounting substrate.

In FIG. 6, the same reference numerals are given to those corresponding to FIG. 3 and duplicated explanations thereof are omitted.

A terminal electrode 5 is provided to a mounting surface 2*e* that is provided in the flange surface 2*d* of the first flanged core 2. Similarly, a terminal electrode 5 is provided to a mounting surface 3*e* that is provided in the flange surface 3*d* of the second flanged core 3. The inductance element 1 is mounted on a mounting substrate 6 in a state that a contact between the terminal electrode 5 and the mounting substrate 6 is maintained by soldering. Thereby, electric current supplied from the mounting substrate 6 is supplied to the inductance element 1 through the terminal electrode 5.

X-X lines shown in this figure by using alternate long and short dashed lines indicate longitudinal axis directions of the winding cores 2*c* and 3*c* (not illustrated) of the flanged cores 2 and 3. In addition, a Y-Y line shown in this figure by using an alternate long and short dashed line indicates a parallel direction to the mounting surfaces 2*e* and 3*e*. More specifically, the longitudinal axes of the winding cores 2*c* and 3*c* of the flanged cores 2 and 3 are set vertically to the mounting surfaces 2*e* and 3*e* in this embodiment.

By setting in this manner, a magnetic flux leakage in a vertical direction of the inductance element 1 can be suppressed mainly by the flange surfaces 2*d* and 3*d* since the longitudinal axis directions of the winding cores 2*c* and 3*c* of the flanged cores 2 and 3 are vertical to the mounting surfaces 2*e* and 3*e* and at the same time, the flange surfaces 2*d* and 3*d* are parallel to the mounting surfaces 2*e* and 3*e* according to the inductance element 1 of this embodiment. Accordingly, it becomes possible to prevent a malfunction of electronic parts used for signal processing, which is possibly caused by the magnetic flux leaking to the vertical direction in case of a multilayered circuit configuration and the like in which a signal circuit substrate is disposed in a vertical direction of a power-supply substrate, for example.

Figure 8:
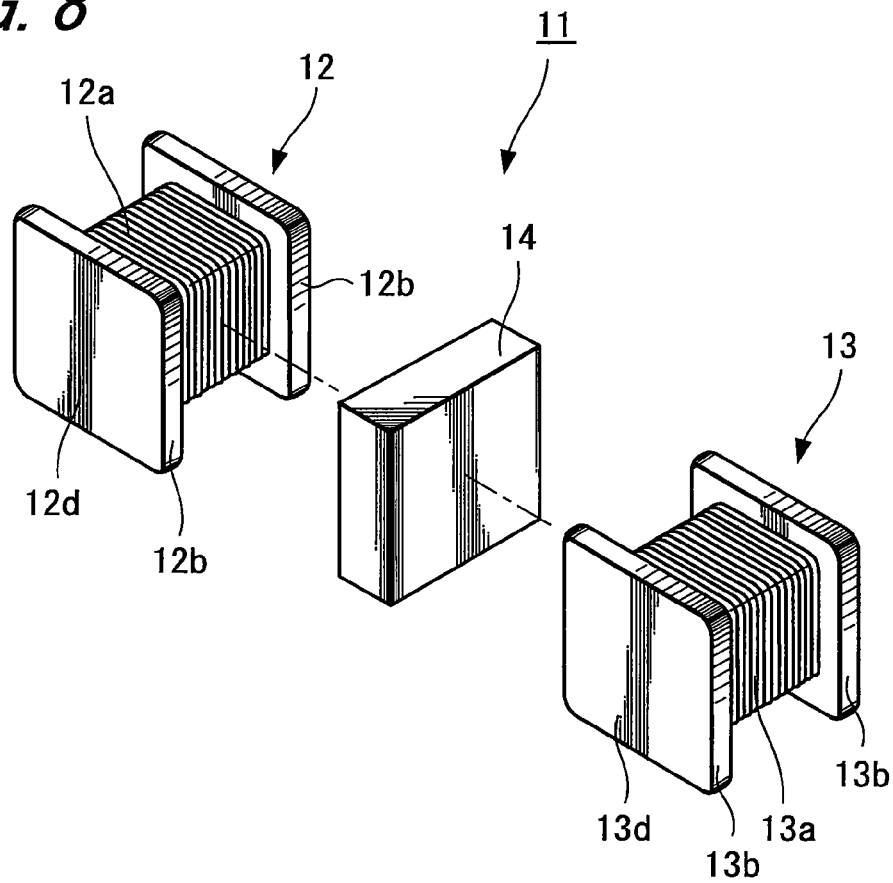
FIG. 8 is an exploded perspective view of a second magnetic element embodying principles of the present invention.

FIG. 8 is an exploded perspective view of a second magnetic element embodying principles of the present invention.

As shown in FIG. 8, an inductance element 11 as a magnetic element is configured to have a first flanged core 12, a second flanged core 13 and an intermediate core 14. In addition, the first flanged core 12 and the second flanged core 13 have the same shape in this embodiment. It should be noted that the first and second flanged cores 12 and 13 may have mutually different diameters of winding cores and shapes of flanges.

The first flanged core 12 is configured to have flange portions 12*b* having approximately square-shaped flange surfaces 12*d* and a first coil 12*a* wound around a winding core (not illustrated) that is integrally connected with the flange portions 12*b*. Similarly, the second flanged core 13 is configured to have flange portions 13*b* having approximately square-shaped flange surfaces 13*d* and a second coil 13*a* wound around a winding core (not illustrated) that is integrally connected with the flange portions 13*b*. In addition, the first flanged core 12 and the second flanged core 13 are formed from a magnetic powder material using Ni—Zn type ferrite.

The intermediate core 14 is configured into a hexahedron which is formed such that a height thereof corresponds to the first flanged core 12 and the second flanged core 13. The intermediate core 14 is formed from a magnetic material using Ni—Zn type ferrite and molded into a rectangular shape by metal mold press, for example.

Figure 9:
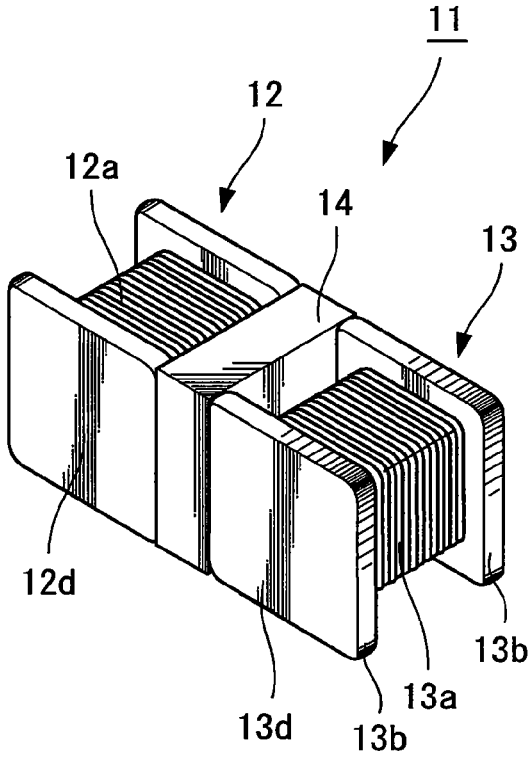
FIG. 9 is a perspective view of the magnetic element of FIG. 8.

FIG. 9 is a perspective view of the magnetic element of FIG. 8.

The inductance element 11 is assembled such that a planar surface portion of the intermediate core 14 corresponds to one side of outer circumferential shape in each of the flange 12*d* of the first flanged core 12 and the flange 13*d* of the second flanged core 13. Also, the inductance element 11 is assembled such that the flange surface 12*d*, the flange surface 13*d* and one surface of the hexahedron of the intermediate core 14 form one planar surface.

Figure 10:
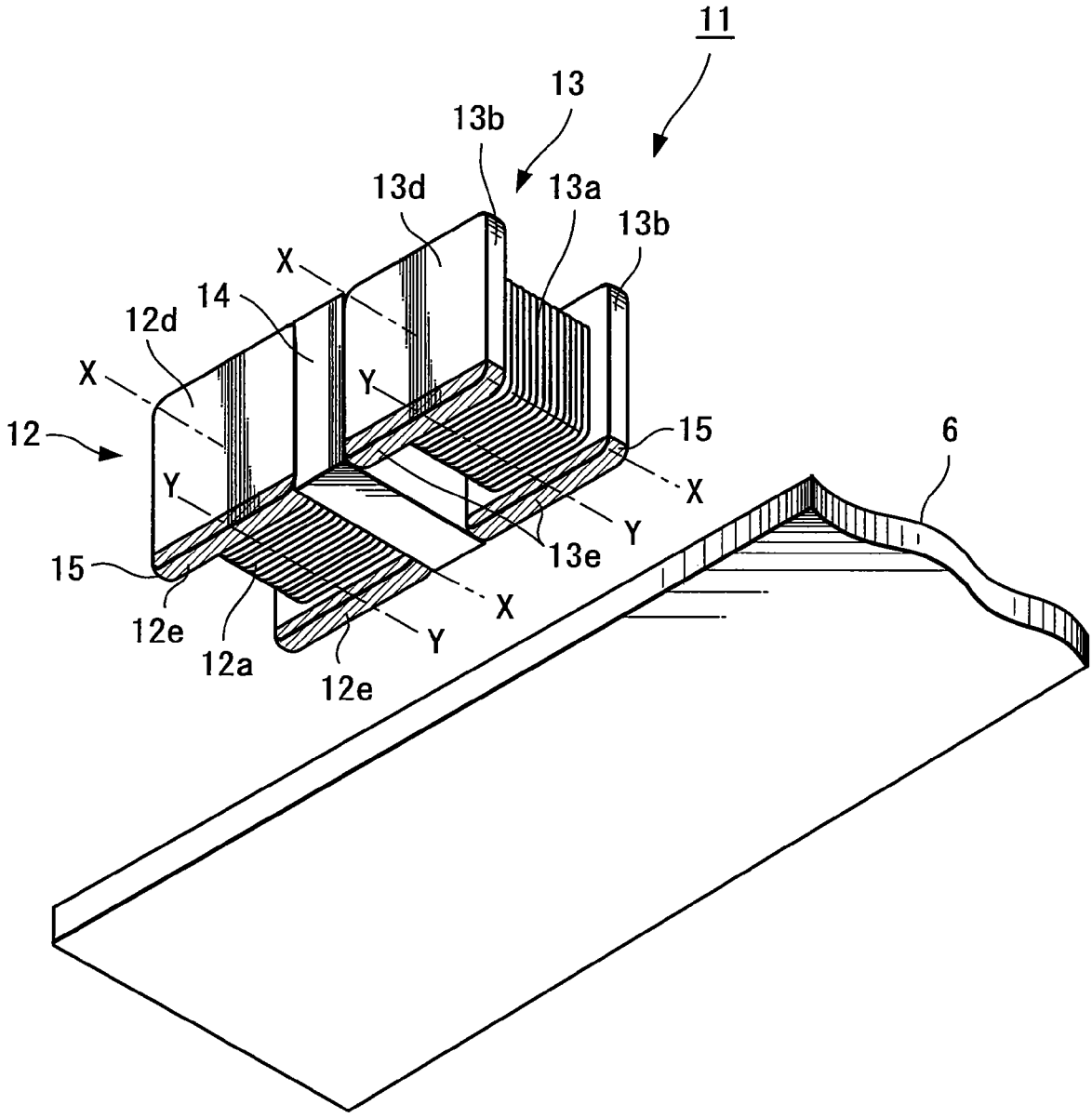
FIG. 10 is a perspective view illustrating installation of the magnetic element of FIGS. 8 and 9 on a mounting substrate.

FIG. 10 is a perspective illustrating installation of the magnetic element of FIGS. 8 and 9 on a mounting substrate.

A terminal electrode 15 is provided to a mounting surface 12*e* that is provided in the flange surface 12*d* of the first flanged core 12. Similarly, a terminal electrode 15 is provided to a mounting surface 13*e* that is provided in the flange surface 13*d* of the second flanged core 13. The terminal electrodes 15 are formed by coating and burning Ag paste on the mounting surfaces 12*e* and 13*e*. It is possible to provide with a magnetic element which excels in productivity, costs and mountability by thus making the core into an electrode type core in which the Ag paste is coated and burned on the portion that becomes the terminal. It should be noted that the inductance element 11 is mounted on the mounting substrate 6 in a state that a contact between the terminal electrode 15 and the mounting substrate 6 is maintained by soldering. Thereby, electric current supplied from the mounting substrate 6 is supplied to the inductance element 11 through the terminal electrode 15.

X-X lines shown in this figure by using alternate long and short dashed lines indicate longitudinal axis directions of winding cores 12*c* and 13*c* (not illustrated) of the flanged cores 12 and 13. In addition, a Y-Y line shown in this figure by using an alternate long and short dashed line indicates a parallel direction to the mounting surfaces 12*e* and 13*e*. More specifically, the longitudinal axes of the winding cores 12*c* and 13*c* of the flanged cores are set horizontally to the mounting surfaces 12*e* and 13*e* in this embodiment.

By setting in this manner, mountability and stability to the mounting substrate 6 are excellent since the longitudinal axis directions of the winding cores 12*c* and 13*c* of the flanged cores 12 and 13 are horizontal to the mounting surfaces 12*e* and 13*e* and at the same time the flange portions 12*b* and 13*b* have the approximately square shapes according to the inductance element 11 of this embodiment.

Figure 11:
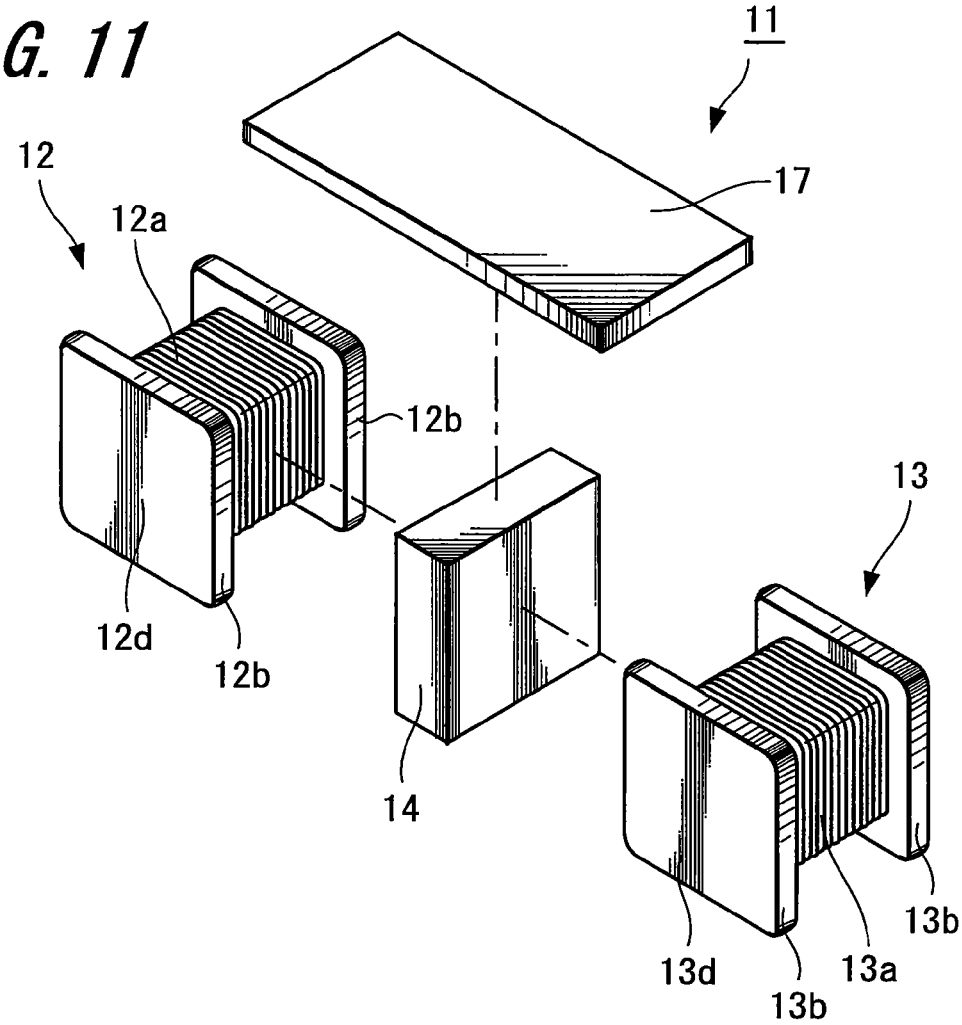
FIG. 11 is an exploded perspective view of a third magnetic element embodying principles of the present invention.

FIG. 11 is an exploded perspective view of a third magnetic element embodying principles of the present invention.

In FIG. 11, the same reference numerals are given to those corresponding to FIG. 8 and duplicated explanations thereof are omitted.

In the inductance element 11 of this embodiment, a magnetic shield plate 17 is provided above the first flanged core 12, second flanged core 13 and intermediate core 14. In addition, the magnetic shield plate 17 is formed from a plate-shaped member made by mixing a magnetic plate of high permeability, resin and magnetic powder, for example.

Figure 12:
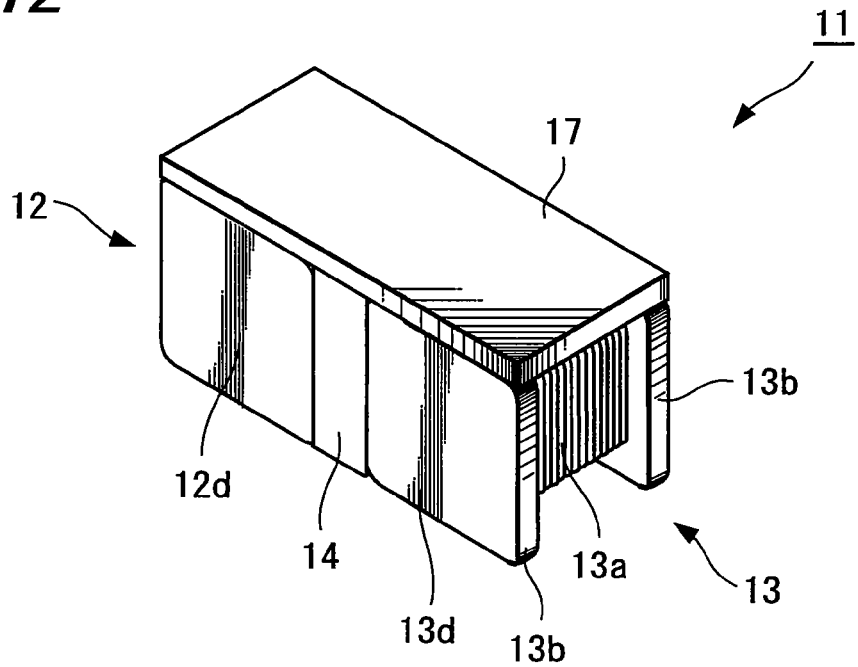
FIG. 12 is a perspective view of the magnetic element of FIG. 11.

FIG. 12 is a perspective view of the magnetic element of FIG. 11.

In FIG. 12, the same reference numerals are given to those corresponding to FIG. 9 and duplicated explanations thereof are omitted.

In this embodiment, the inductance element 11 is assembled such that the flange surface 12*d*, the flange surface 13*d* and one surface of the hexahedral intermediate core 14 form one planar surface, but the magnetic shield plate 17 is attached on the side of upper end portion of this planar surface in a manner covering the coils 12*a* and 13*a*.

Figure 13:
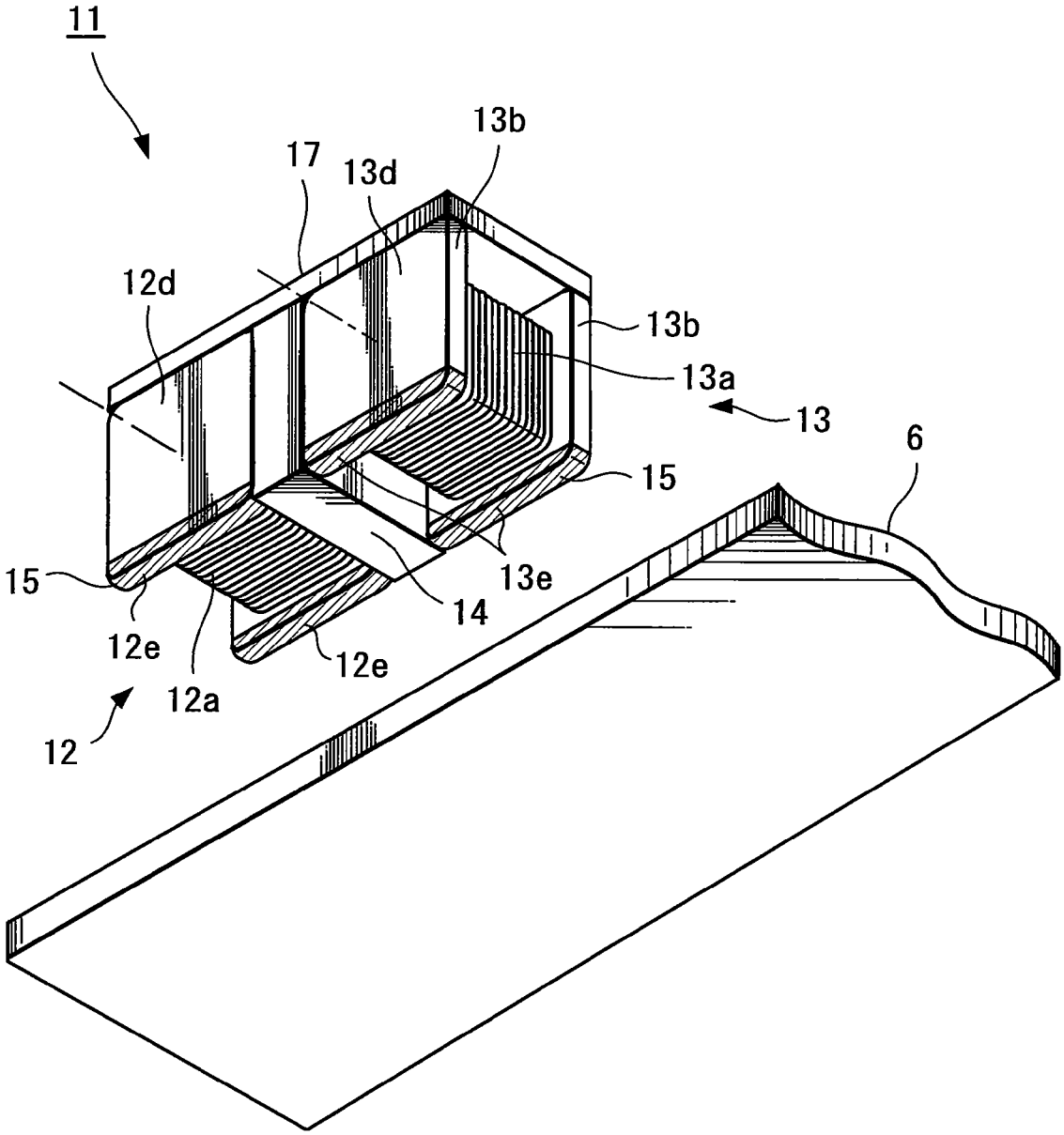
FIG. 13 is a perspective view illustrating installation of the magnetic element of FIGS. 11 and 12 on a mounting substrate.

FIG. 13 is a perspective illustrating installation of the magnetic element of FIGS. 11 and 12 on a mounting substrate.

In FIG. 13, the same reference numerals are given to those corresponding to FIG. 10 and duplicated explanations thereof are omitted.

In this embodiment, the inductance element 11 is installed on the mounting substrate 6 in a state that the magnetic shield plate 17 is attached on the opposite side to the mounting surfaces 12*e* and 13*e* of the flanged cores 12 and 13 to be installed on the mounting substrate 6.

In the inductance element 11 of this embodiment, since the configuration provided with the magnetic shield plate 17 on the upper portion of the element is adopted, it becomes possible to prevent such failure that the magnetic flux leaks from the upper portion of the inductance element 11 and it is possible to provide with the highly reliable inductance element 11. It should be noted that the magnetic flux leakage can be reduced furthermore by attaching the magnetic shield plates 17 even to lateral portions of the flanged cores 12 and 13 when there is no limitation on a size of the element.

Figure 14:
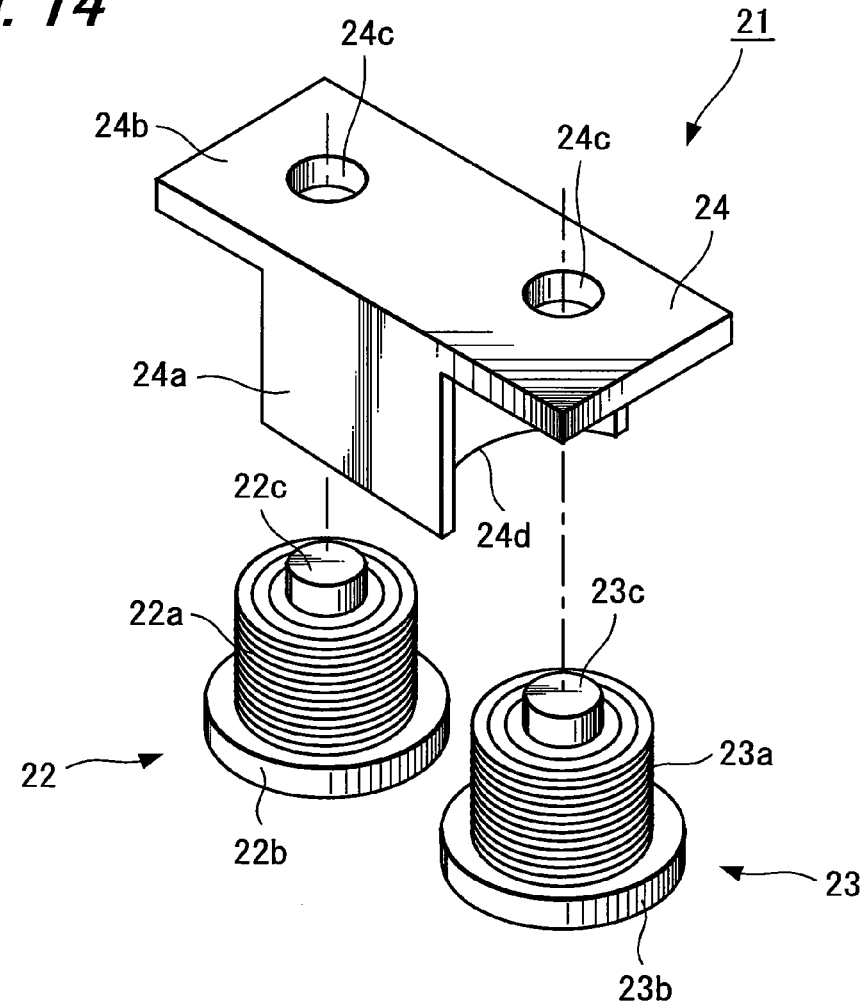
FIG. 14 is an exploded perspective view of a fourth magnetic element embodying principles of the present invention.

FIG. 14 is an exploded perspective view of a fourth magnetic element embodying principles of the present invention.

As shown in FIG. 14, an inductance element 21 as a magnetic element is configured to have a first flanged core 22, a second flanged core 23 and an intermediate core 24. In addition, the first flanged core 22 and the second flanged core 23 have the same shape in this embodiment. It should be noted that the first and second flanged cores 22 and 23 may have mutually different diameters of winding cores and shapes of the flanges.

The first flanged core 22 is a so-called single-flanged core and is configured to have a flange portion 22*b* having a planar-shaped flange surface (not illustrated) and a first coil 22*a* wound around a winding core 22*c* that is integrally connected with the flange portion 22*b*. In addition, a top end portion of the winding core 22*c* on the opposite side to the flange portion 22*b* is formed in a manner projecting from the first coil 22*a*. Similarly, the second flanged core 23 is a single-flanged core and is configured to have a flange portion 23*b* having a planar-shaped flange surface (not illustrated) and a second coil 23*a* wound around a winding core 23*c* that is integrally connected with the flange portion 23*b*. In addition, a top end portion of the winding core 23*c* on the opposite side to the flange portion 23*b* is formed in a manner projecting from the second coil 23*a*. It should be noted that the first flanged core 22 and the second flanged core 23 are formed from a magnetic material using Ni—Zn type ferrite.

The intermediate core 24 is configured to have a lower structure portion 24*a* disposed between the first flanged core 22 and the second flanged core 23 and an upper structure portion 24*b* disposed astride over the first flanged core 22 and the second flanged core 23, and a cross-sectional plane thereof has an approximately T-type external shape. Fitting portions 24*d* having such shapes that correspond to external shapes of the flange 22*b* and flange 23*b* are formed in surfaces of the lower structure portion 24*a* opposing to the first flanged core 22 and the second flanged core 23. In addition, winding core fitting holes 24*c* for fitting to the winding cores 22*c* and 23*c* projected from the coils are formed in the upper structure portion 24*b*. It should be noted that the intermediate core 24 is formed from a material using Ni—Zn type ferrite and molded by metal mold press, for example.

Figure 15:
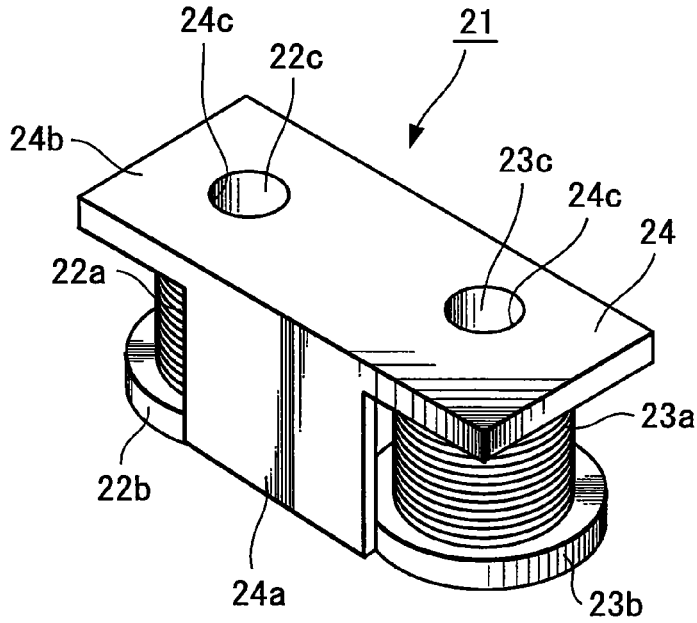
FIG. 15 is a perspective view of the magnetic element of FIG. 14.

FIG. 15 is a perspective view of the magnetic element of FIG. 14.

In the inductance element 21 of this embodiment, the inductance element 21 is assembled such that the outer circumferences of the flange portions 22*b* and 23*b* of the flanged cores 22 and 23 are partially fit into the fitting portions 24*d* provided in the lower structure body 24*a*, the top end portions of the winding cores 22*c* and 23*c* of the flanged cores 22 and 23 are inserted into the winding core fitting holes 24*c* provided in the upper structure body 24*b*, and end surfaces of the top end portions of the winding cores 22*c*, 23*c* and an upper surface of the upper structure body form one planar surface.

Figure 16:
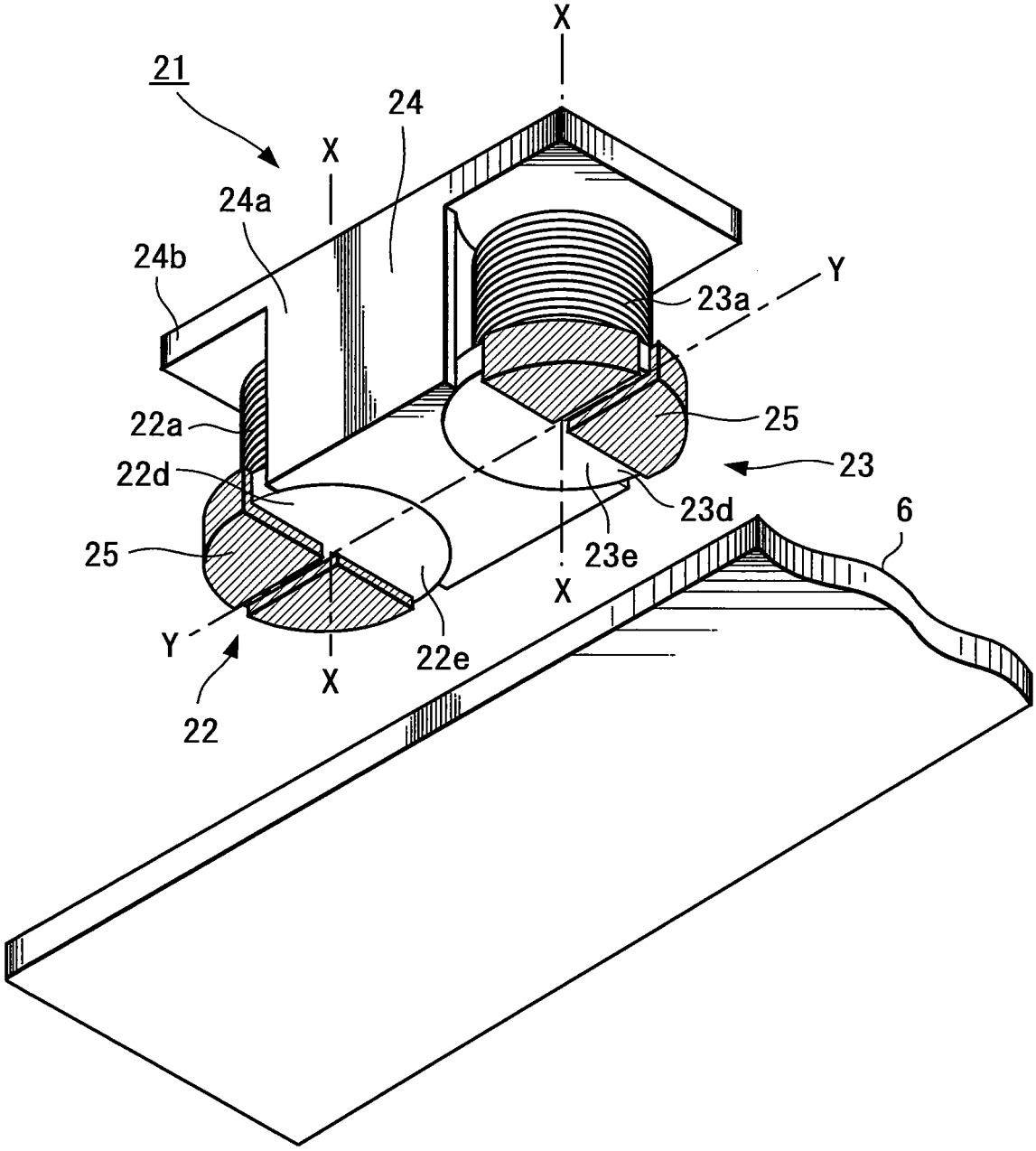
FIG. 16 is a perspective view illustrating installation of the magnetic element of FIGS. 14 and 15 on a mounting substrate.

FIG. 16 is a perspective view illustrating installation of the magnetic element of FIGS. 14 and 15 on a mounting substrate.

In FIG. 16, the same reference numerals are given to those corresponding to FIG. 15 and duplicated explanations thereof are omitted.

A terminal electrode 25 is provided to a mounting surface 22*e* that is provided on a flange surface 22*d* of the first flanged core 22. Similarly, a terminal electrode 25 is provided to a mounting surface 23*e* that is provided on a flange surface 23*d* of the second flanged core 23. The inductance element 21 is mounted on the mounting substrate 6 in a state that a contact between the terminal electrode 25 and the mounting substrate 6 is maintained by soldering. Thereby, electric current supplied from the mounting substrate 6 is supplied to the inductance element 21 through the terminal electrode 25.

X-X lines shown in this figure by using alternate long and short dashed lines indicate longitudinal axis directions of the winding cores 22*c* and 23*c* (not illustrated) of the flanged cores 22 and 23. In addition, a Y-Y line shown in this figure by using an alternate long and short dashed line indicates a parallel direction to the mounting surfaces 22*e* and 23*e*. More specifically, the longitudinal axes of the winding cores 22*c* and 23*c* of the flanged cores 22 and 23 are set vertically to the mounting surfaces 22*e* and 23*e* in this embodiment.

According to the inductance element 21 of this embodiment, positioning and fixing become easy and secure at the time of assembling the parts since the top ends of the winding cores 22*c* and 23*c* of the flanged cores are inserted into the winding core fitting holes 24*c*, and furthermore it is possible to suppress the leaking magnetic flux from the coils since the upper surface portions of the coils 22*a* and 23*a* are covered by the upper structure body 24*b* of the intermediate core 24.

It should be noted that the magnetic material used for forming the first flanged core, the second flanged core and the intermediate core is not limited to Ni—Zn type ferrite and it is possible to use Mn—Zn type ferrite, metal type magnetic material, amorphous type magnetic material and the like.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A magnetic element comprising:

a first core and a second core, each of which has a winding core and a flange portion provided at least at one end of the winding core, the winding core being integrally connected with the flange portion, the flange portion having a flange surface, the first and second winding cores aligned along parallel axes;

an intermediate core disposed between said first core and said second core; and coils wound around said first winding core and said second winding core respectively, wherein, said flange portion has an outer circular circumference, a shape of said intermediate core formed on a plane perpendicular to an axis direction of the winding cores of said first core and said second core has line-symmetry with respect to a line segment orthogonally connecting axes of the winding cores of said first core and said second core as well as a straight line bisecting said line segment in a vertical direction, respectively, said intermediate core includes recess portions formed on surfaces opposing said first core and said second core, said recess portions having shapes into which fit parts of the flange portions of said first core and said second core, and said first core and said second core are fixed to said intermediate core.

2. The magnetic element according to claim 1 wherein a gap is formed between the recess portions of said intermediate core and at least one of the flange portions of said first core and said second core.

3. The magnetic element according to claim 1, wherein said first core and said second core are fixed to said intermediate core with an adhesive.

4. The magnetic element according to claim 1, wherein a terminal electrode is provided on the flange surfaces of said first core and said second core.

* * * * *